US005949309A

United States Patent [19]

Correa

[11] Patent Number: 5,949,309

[45] Date of Patent: Sep. 7, 1999

[54] DIELECTRIC RESONATOR FILTER CONFIGURED TO FILTER RADIO FREQUENCY SIGNALS IN A TRANSMIT SYSTEM

[75] Inventor: Paulo Correa, Kingston, Pa.

[73] Assignee: Communication Microwave Corporation, Mountaintop, Pa.

[21] Appl. No.: 08/862,716

[22] Filed: May 23, 1997

Related U.S. Application Data

[63] Continuation of application No. 08/818,896, Mar. 17, 1997, abandoned.

[51] Int. Cl.[6] ..... H01P 1/20; H01P 7/10

[52] U.S. Cl. ..... 333/202; 333/219.1; 333/234

[58] Field of Search ..... 333/202, 208, 333/209, 219.1, 234, 235

[56] References Cited

U.S. PATENT DOCUMENTS

| | | | |
|---|---|---|---|
| 4,028,652 | 6/1977 | Wakino et al. | 333/202 |
| 4,251,787 | 2/1981 | Young et al. | 333/209 |
| 4,255,729 | 3/1981 | Fukasawa et al. | 333/202 |
| 4,477,785 | 10/1984 | Atia | 333/202 |
| 4,639,699 | 1/1987 | Nishikawa et al. | 333/202 |
| 4,862,122 | 8/1989 | Blair, Jr. et al. | 333/202 |
| 5,051,714 | 9/1991 | Bentivenga et al. | 333/227 |
| 5,083,102 | 1/1992 | Zaki | 333/212 |
| 5,373,270 | 12/1994 | Blair et al. | 333/202 |
| 5,406,234 | 4/1995 | Willems | 333/203 |
| 5,525,945 | 6/1996 | Chiappetta et al. | 333/202 |
| 5,661,441 | 8/1997 | Morino et al. | 333/219.1 X |
| 5,714,919 | 2/1998 | Satoh et al. | 333/202 |

*Primary Examiner*—Seungsook Ham

*Attorney, Agent, or Firm*—Oblon, Spivak, McClelland, Maier & Neustadt, P.C.

[57] ABSTRACT

A dielectric resonator filter is configured to suppress emissions in an out-of-band frequency portion of an amplified radio frequency (RF) signal prior to transmission of the RF signal by an antenna assembly. The filter includes plural tunable resonant cavities, each of which have a dielectric resonator and are arranged to suppress a magnitude of a frequency component in the out-of-band frequency portion of the RF signal. The amplified RF signal is applied to the plural resonant cavities with a microstrip transmission line. The dielectric resonators are arranged so as to automatically compensate for temperature-induced resonance condition variations.

18 Claims, 9 Drawing Sheets

DIELECTRIC RESONATOR FILTER CONFIGURED TO FILTER RADIO FREQUENCY SIGNALS IN A TRANSMIT SYSTEM

CROSS REFERENCE TO RELATED APPLICATION

This application is a continuation of U.S. patent application Ser. No. 08/818,896 (now abandoned) filed Mar. 17, 1997 entitled Dielectric Resonator Filter Configured To Filter Radio Frequency Signals In A Transmit System.

BACKGROUND OF THE INVENTION

1. Field of the Invention

The present dielectric resonator filter relates to radio frequency (RF) transmission systems using spectral shaping techniques to meet spectral occupancy requirements. More particularly, the present invention relates to RF signal filters used to suppress an out-of-band portion of a RF signal to be transmitted from a transmitting device.

2. Discussion of the Background

Multi-channel multi-point distribution service (MMDS), multi-point distribution service (MDS), Instructional Television Fixed Service (ITFS), and private operational fixed service (OFS) are various groups of channels that collectively are referred to as "wireless cable". A description of a wireless cable system, including system components, frequency ranges, channel allocations, etc., is provided in co-pending provisional application, U.S. Ser. No. 60/021,271, entitled "MODULAR BROADBAND TRANSMISSION SYSTEM AND METHODS", filed Jul. 5, 1996, the contents of which are incorporated herein by reference. A description of conventional wireless cable transmitters is provided in Chapter 12 of Berkoff, S, et al., "Wireless Cable and SMATV", Baylin Publications, 1992, pp. 237–252, the contents of this book being incorporated herein by reference.

The Federal Communications Commission (FCC) has allocated frequency spectrum in the 2.150 GHz to 2.162 GHz and 2.5 GHz to 2.686 GHz ranges for wireless cable services. Traditionally, these frequency ranges have been used to broadcast television signals in an analog signal format (e.g., National Television System Committee, NTSC format). The FCC places particular spectral occupancy requirements on wireless cable transmitters so as to minimize "out-of-band" emissions that disturb adjacent channels due to harmonics, spurious responses and intermodulation products. In particular, for signals transmitted in an analog format, the FCC requires that the maximum out-of-band power of a wireless cable channel must be attenuated 38 dB relative to a peak visual carrier at the channel edges and constant slope attenuation from this level to 60 dB relative to the peak visual carrier at 1 MHZ below the lower band edge and 0.5 MHZ above the upper band edge. All out of band emissions extending beyond these frequencies must be attenuated 60 dB below the peak visual carrier power. For signals transmitted in a digital format, the FCC requires that 38 dB of attenuation be provided relative to a licensed average power level at the channel edges, constant slope attenuation from that level to 60 dB attenuation at 3 MHZ above the upper and below the lower channel edge, and 60 dB attenuation below the licensed average power level at all other frequencies.

Traditionally, the out-of-band portion for each channel has been suppressed in conventional wireless cable transmitters by relying on a combination of (1) an inherent spectral shape of the analog video signals, (2) channel filtering of each analog video signal before passing the respective signals to a high-power amplifier, and (3) operating a high-power amplifier at the transmitter in a linear range, well below a compression point of the high-power amplifier (which is an expensive solution that requires a large number of amplifiers to provide the requisite output power).

With the recent technological advance of digital video and signal processing techniques, transmitting video signals in a digital format will likely be adopted in the wireless cable industry as the future format standard. The present inventors identified that conventional wireless cable transmitters are not well suited for supporting the emerging digital format. Identified problems include (1) different spectral characteristics of digitally formatted signals as compared with analog formatted signals, (2) increased emphasis on operating a transmitter at a higher power and closer to an amplifier compression point so as to economically provide greater coverage and greater information content per wireless cable channel, and (3) lack of filtering support for a dual-mode transmitter which is configured to transmit both analog and digital signals. In response to the technological evolution in the wireless cable industry, the present inventors identified the need for a filter used at a transmitter site (between the amplifier and a transmit antenna) that suppresses the out-of-band portion of digital signals for each channel to within FCC regulated levels. In order to be a viable commercial product, the inventors determined that each filter for each channel must be able to accommodate 200 W (average power), economical to manufacture, and exhibit a performance that is invariant to temperature fluctuation associated with operating in a high-power transmitter environment.

Most conventional filter structures are configured for use in receive-only systems and cannot handle the high-power wireless cable signals at frequencies above 2 GHz. A related issue, is a lack of temperature compensation features in conventional filters that would prevent the filter response from varying when subject to significant temperature variations resulting from the high power transmitter application. Resonator cavities and other techniques used for shaping RF energy in conventional systems, are subject to varying performances as a function of temperature. In particular, these variations become particularly pronounced at frequencies above 2 GHz where the RF wavelengths are small relative to thermal-induced expansion/concentration movement of mechanical components (e.g., conductive cavity walls). One reason for the varying performance is that the cavities increase in size with increasing temperature, which results in a downward shift in frequency response. Furthermore, impedance disturbances caused by notch filter devices would create linear distortion in the digital signals.

Dielectric resonators have been used in the RF communications industry for signal oscillator applications. A feature that makes a dielectric resonator attractive in oscillator applications is its inherent frequency stability. More recently, dielectric resonators have been used in filtering applications, two examples of which are discussed below.

A first conventional dielectric notch filter, shown in FIG. 1, was disclosed in U.S. Pat. No. 4,862,122. In FIG. 1, a filter 10 includes a coaxial cable transmission line 12 that couples RF energy at frequencies below 1 GHz to various dielectric resonator devices 14, which are spaced ¼ of a wavelength from one another. The dielectric resonator devices 14 are directly connected to the coaxial transmission line 12 via separate connectors 18.

As shown in FIG. 2, each dielectric resonator device has a separate cylindrical housing 16 which includes a dielectric support 24, a dielectric resonator 26, a tuning disk 20 and a coupling loop 28. Sub-GHz energy from the coaxial transmission line 12 is coupled through the electrical connector 18 and into the housing 16 via the coupling loop 28. The dielectric resonator 26 cooperates with the tuning disk 20 so as to provide a "notch" spectral response for suppressing a particular frequency from the signal passed through the transmission line 12.

As identified by the present inventors, the above described conventional dielectric notch filter would have limited applicability in a wireless cable transmitter application because the dielectric notch filter is (1) configured for low power receive-only filtering operations at sub-GHz frequencies, (2) bulky in construction due to separate housings 16 needed for the resonator device and separate connectors 18, (3) not temperature invariant or free from impedance disturbances, and (4) not guaranteed to provide a symmetric frequency response and group delay.

FIG. 3 shows another conventional filter that was disclosed in U.S. Pat. No. 5,373,270 and described as an improved multi-cavity dielectric filter in which separate dielectric resonators are placed within a single cylindrical housing instead of the individual housings 16 as shown in FIG. 1. A rectangular shaped waveguide 34 is equipped with connectors 36 for receiving and outputting a RF signal in the sub-GHz frequency range. A center conductor 38 is provided within the transmission line 34 to which a coupling loop 40 is provided through an orifice 47 for each of plural cavities 65. Each cavity 65 is defined by isolation plates 44 and has a dielectric resonator 42 secured therein by a support element 46. The support 46 mechanically couples the dielectric resonator 42 to the walls of the cavity 65. Separate tuning slugs 56 are secured to the housing 32 through a nut 69.

As recognized by the present inventors, the above described multi-cavity dielectric filter provides the RF signal to each of the resonant cavities 65 via separate loops 40, which are difficult to manufacture and will not likely support high power transmitter applications at frequencies above 1 GHz. Furthermore, the above-described multi-cavity dielectric filter does not expressly provide temperature compensation or impedance compensation to temperature variation and offset impedance disturbances caused by the respective dielectric resonators 42.

SUMMARY OF THE INVENTION

Accordingly, one object of this invention is to provide a novel dielectric resonator filter that overcomes the above-mentioned problems.

It is another object of the present invention to provide a dielectric resonator filter that filters an out-of-band portion of a high-power RF signal and provides stable performance when subject to temperature variations.

Still a further object of the present invention is to provide a dielectric resonator filter that provides a symmetrical frequency response and symmetrical group delay to a digital signal or an analog signal.

These and other objects are accomplished by a novel dielectric resonator filter including multiple resonant cavities with respective dielectric resonators contained therein. The novel dielectric resonator filter also includes a microstrip transmission line used to feed a high-power input signal to the resonant cavities. The dielectric resonators have a positive temperature coefficient selected to compensate for temperature induced frequency shifts caused by a negative temperature coefficient associated with mechanical resonant cavities. The dielectric resonators are not directly attached to the microstrip transmission line so thermal expansion/contraction of the microstrip transmission line does not reposition the dielectric resonators in the resonant cavities. The microstrip transmission line includes stubs located opposite to selected of the dielectric resonators for ensuring that the signals are not corrupted by asymmetric filtering or group delay resulting from linear distortion. Tuning disks are included in the resonant cavities so each dielectric resonators may be tuned for use at any channel within a band defined by the size of the resonator and also at frequencies other than those allocated by the United States.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
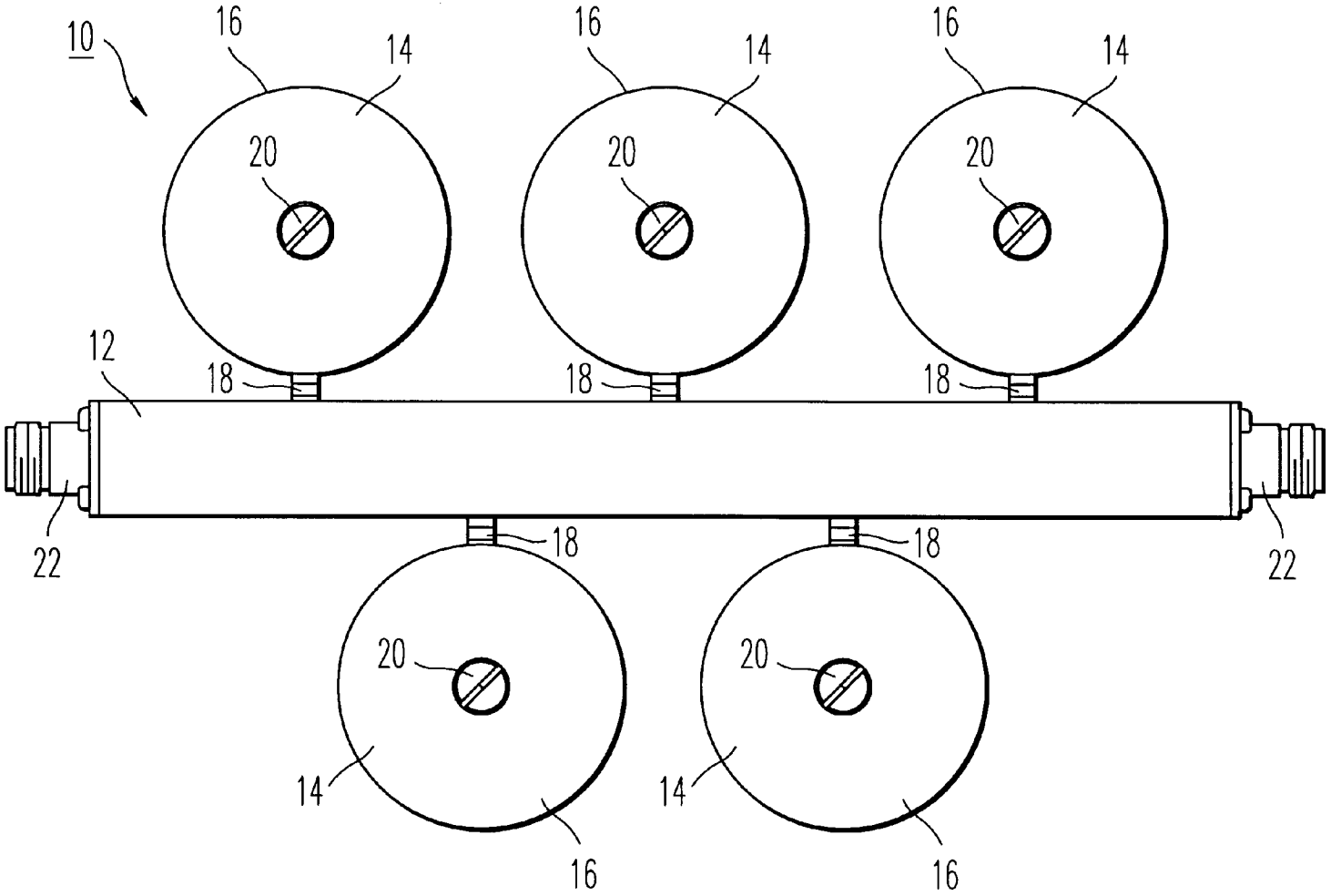
FIG. 1 PRIOR ART
FIG. 1 is a top view of a conventional dielectric notch filter having plural discrete housings.
Figure 2:
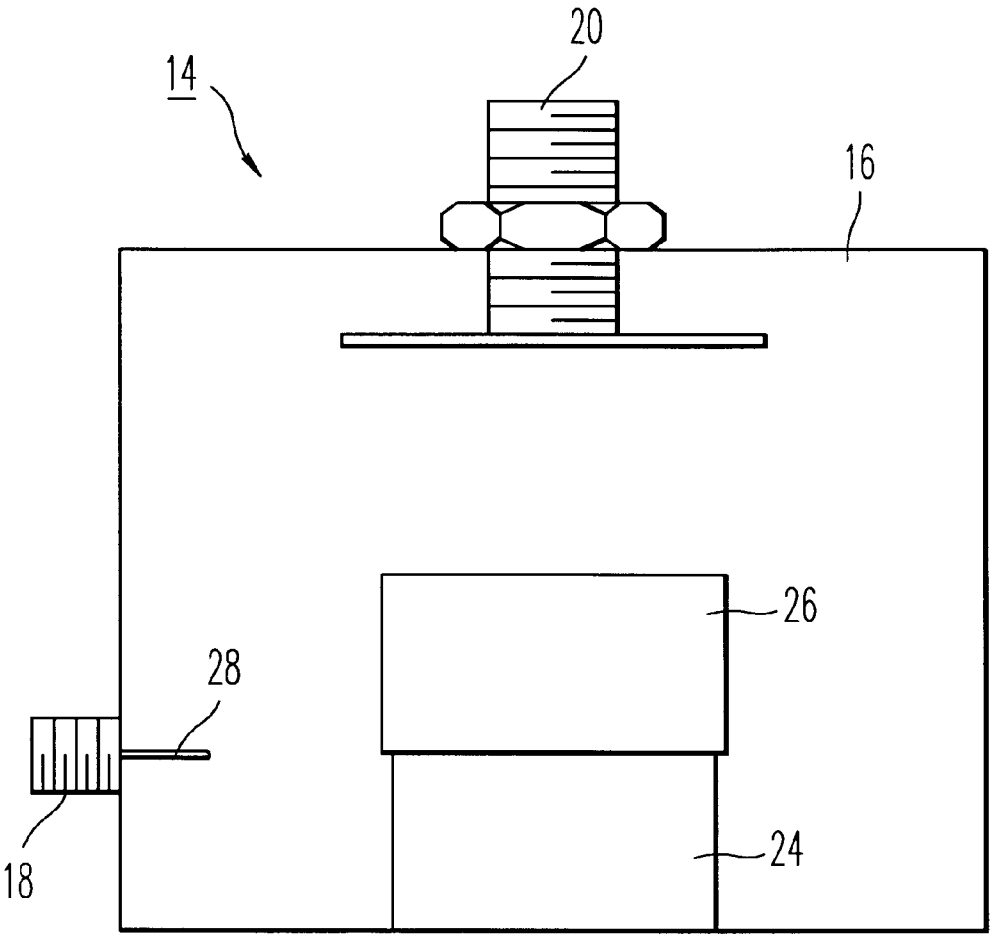
FIG. 2 PRIOR ART
FIG. 2 is a cross-section side view of one of the conventional dielectric resonator housings shown in FIG. 1.
Figure 3:
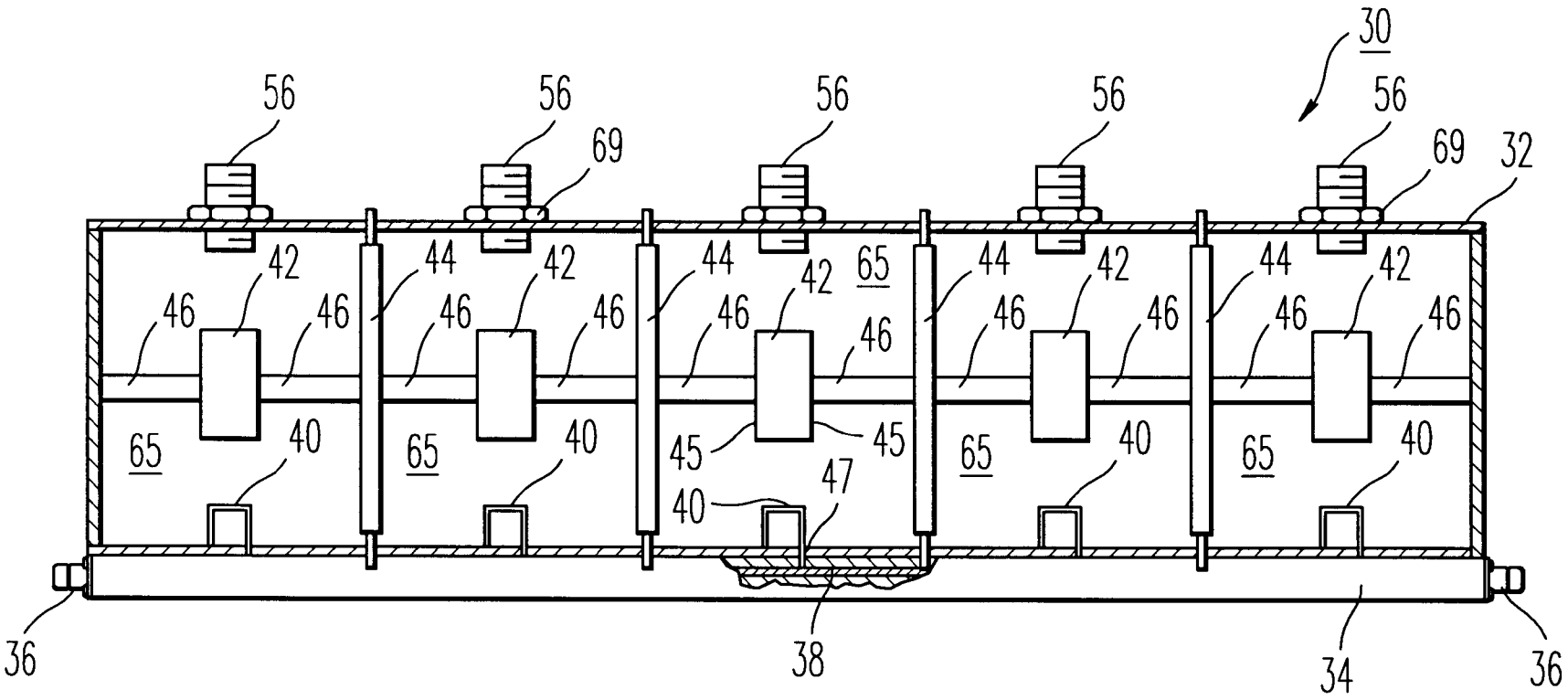
FIG. 3 PRIOR ART
FIG. 3 is a cross-section side view of a conventional multi-cavity dielectric filter.
Figure 4:
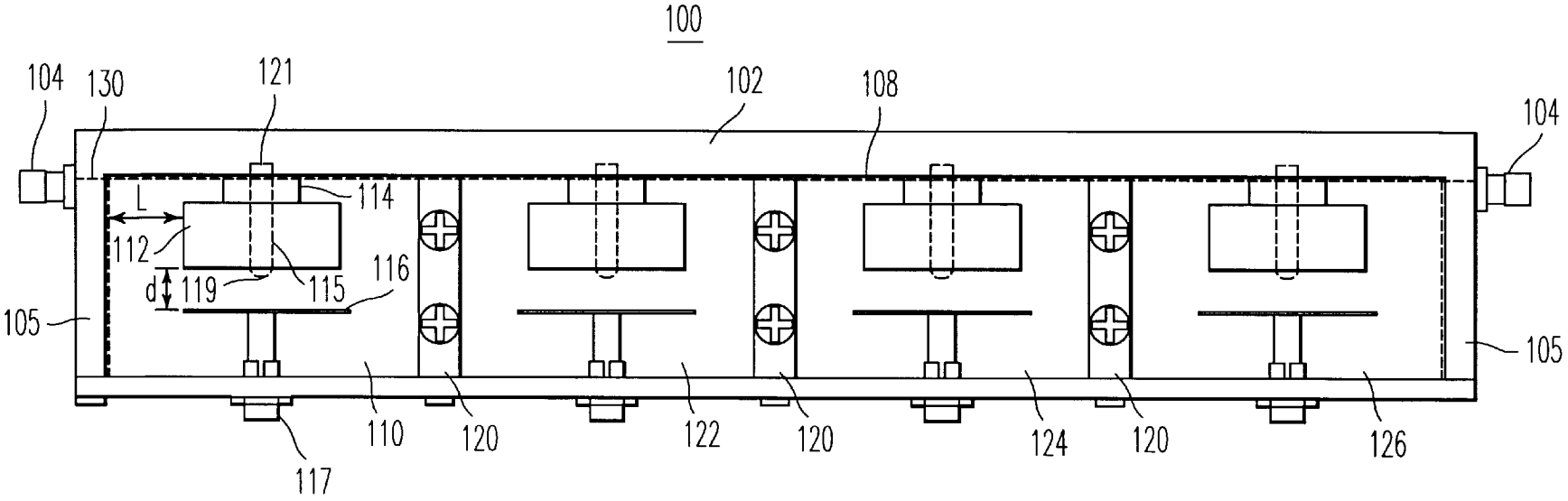
FIG. 4 is a cross-section top view of a dielectric resonator filter according to the present invention.

Referring now to the drawings wherein like reference numerals designate identical or corresponding parts throughout the several views, and more particularly to FIG. 4 thereof, there is illustrated a temperature stable dielectric resonator filter 100 including four resonant cavities 110, 122, 124, and 126, where each cavity is tuned to provide at least 12 dB of attenuation at a particular frequency offset from a passband (channel band) edge. While four resonant cavities are shown in FIG. 4, a smaller or greater number of cavities may also be used according to the teachings of the present disclosure and according to a number of frequencies to be notched. The cavities are housed within a housing 102 which is preferably made of a metallic, conductive material such as aluminum, although other conductive materials having a predictable temperature coefficient may be used as well.

The individual cavities 110, 122, 124 and 126 are separated within the housing 102 by conductive partitions 120 made of aluminum or another suitable conductor. Aluminum is preferred because it exhibits a negative temperature coefficient of about 3 parts per million/° C. (i.e., 3 ppm of downward frequency shift for each degree of temperature change). The cavities 110, 122, 124 and 126 include a dielectric resonator 112 made from materials such as barium titanate or another material which can exhibit a positive temperature coefficient of about 3 ppm/° C. Matching the magnitudes of the temperature coefficients of the material that define the respective cavities 110, 122, 124, and 126 with the temperature coefficient of the dielectric resonator material is an important structural feature of the present invention because the matched temperature coefficients enable the automatic temperature compensation feature of the present invention.

Outer walls of the outermost cavities 110 and 126 are defined by end walls 105 of the housing 102. Connectors 104 and 106 are N connectors when used for high-power wireless cable channels (e.g., 200 W/channel) and SMA connectors in low power wireless cable channels (e.g., 15 W/channel). Since the exemplary embodiment is directed to a high power channel, the connectors 104 and 106 are N connectors and extend through the end walls 105 so as to define a signal path for an amplified RF input signal provided from an external source to a microstrip transmission line 130. The connector 106 provides a filtered output RF signal through the opposing end wall 105.

Figure 8A:
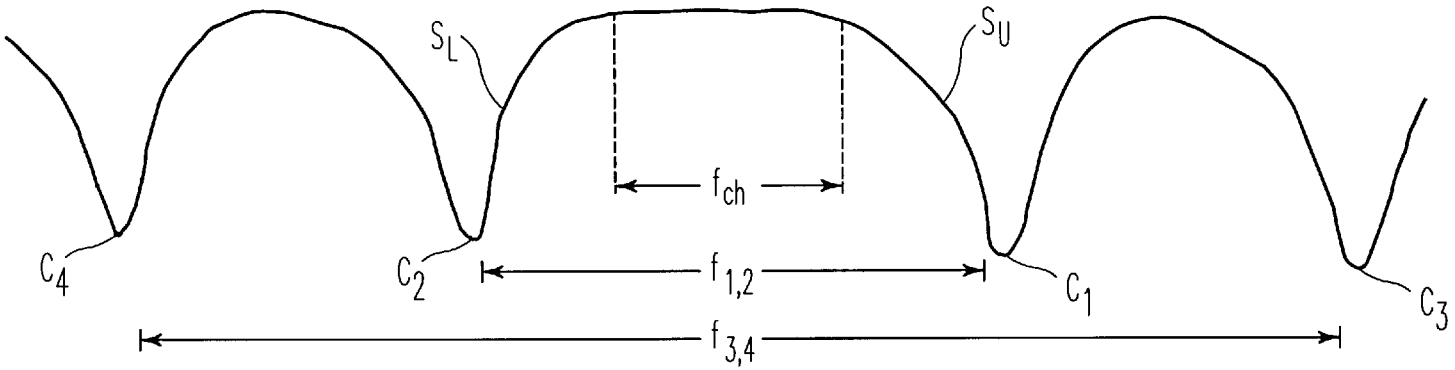
FIGS. 8A–8C are respective frequency response, return loss and group delay graphs corresponding to the dielectric resonator filter according to the present invention without the benefit of impedance matching stubs on a microstrip transmission line.
Figure 9A:
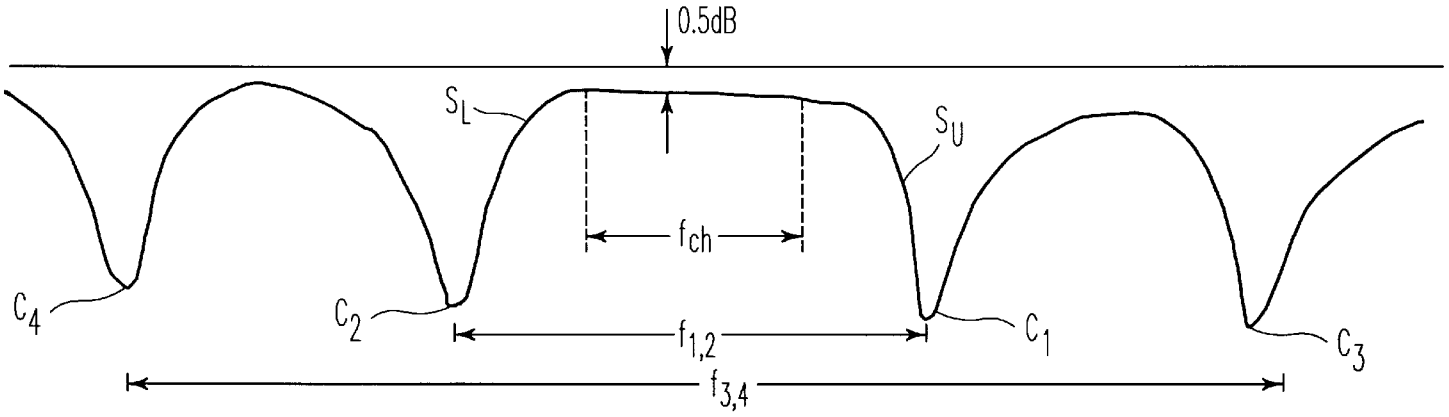
FIGS. 9A–9C are respective frequency response, return loss and group delay graphs corresponding to the dielectric resonator filter according to the present invention with impedance matching stubs on a microstrip transmission line.

The following discussion is directed to particular features of the first cavity 110, which is configured to provide a notched frequency response, C1 as shown in FIGS. 8A and 9A, at 3 MHZ above an upper edge frequency of a channel band (pass band). The other cavities 122, 124 and 126 have a similar construction although are configured in size to provide notched frequency responses at 3 MHZ below the lower channel band edge, 9 MHZ above the upper channel band edge, and 9 MHZ below the lower channel band edge, respectively. The interlace of frequencies provides the necessary isolation between notches so that they do not interfere with one another.

As shown in FIG. 4, the cavity 110 includes a dielectric resonator 112, a base 114, and a tuning disk 116. Walls 120, 105 and housing 102 define the cavities 110, 122, 124 and 126 as well as provide electrical isolation between adjacent of the cavities, 110, 122, 124, and 126. In the preferred embodiment, the housing 102 and the hollowed portion of the housing 102 have rectangular cross-sections in both a direction parallel to the signal flow (from left to right across the page) and normal to the signal flow. Other shapes can be used provided the proximity of the respective walls of the cavities 110, 122, 124 and 126 to the dielectric resonators 112 does not control a loading effect on the dielectric resonator material. Accordingly, a distance "d" from the tuning disk 116 to the dielectric resonator 112 will, generally, not be greater than a distance "L" from the closest sidewall 105/120 to the dielectric resonator 112.

In the preferred embodiment, the distance "L" is set within a range of 0.4 to 0.6 inches. The uppermost constraint on the distance "L" is controlled by the amount of physical space available for hosting the filter 100 in the wireless cable transmitter. If the distance "L" is set outside of the above described constraints, a different dielectric resonator material will be required that exhibits a greater magnitude than 3 ppm/° C. for L being below the range, and less than 3 ppm/° C. for L being greater than the described range. When establishing the upper bound on the distance L, it must be considered that the preferred embodiment is directed to a wireless cable transmitter application. Consequently, the amount of space available for hosting a separate filter 100 in the wireless cable transmitter for each of the wireless channels is limited. Thus, there is a practical constraint on the size of the respective cavities 110, 122, 124, and 126 that will ensure some capacitive coupling exists between the respective walls of the cavities 110, 122, 124, and 126, and consequently, a resultant temperature-dependent loading effect on the dielectric resonator 112.

The tuning disk 116 is made of a metallic material such a copper and has a diameter that is approximately the same as a diameter of the dielectric resonator 112. A distance "d" between the tuning disk 116 and the dielectric resonator 112 is controlled by a threaded rod portion 117 of the tuning disk 116. The distance "d" affects the tuned frequency and breadth of the notched response of the dielectric resonator 112 due to a capacitive loading. The tuning disk is manually controlled, and thus does not provide the automatic temperature compensation feature of the present invention. In an alternative embodiment, the tuning disks may be automatically controlled with individual stepping motors controlled by a microprocessor that receives temperature readings from the respective cavities. Expense and manufacturing complexity are concerns with this alternative embodiment.

A polyester screw 119 is inserted through a bore 115 in the dielectric resonator 112 and base 114, and attaches to the housing 102 in a void 121 that receives an end of the screw 119. Thus, the dielectric resonator 112 and base 114 are directly connected to the housing 102.

The dielectric resonator 112 is preferably made from a ceramic material such as barium titanate or another material that exhibits a 3 ppm/° C. temperature coefficient. These types of dielectric resonator materials are chosen because they exhibit a temperature coefficient that matches in magnitude with a temperature coefficient of the materials defining the respective cavities 110, 122, 124, and 126 in the present wireless cable application.

Dielectric resonator materials are characterized as having a "positive", "zero", or "negative" temperature coefficient. Dielectric resonators with zero valued temperature coefficients have a dielectric constant that are temperature invariant. Dielectric resonators with positive or negative valued temperature coefficients have a dielectric constant that varies with temperature. Thus, in order to automatically compensate for temperature induced changes in the dimensions in the resonant cavity 110, a dielectric resonator material is used with an opposite temperature coefficient of equivalent, or nearly equivalent magnitude. Moreover, a dielectric resonator material is used that tends to increase the resonant frequency for higher temperatures (e.g., a positive valued temperature coefficient) because a change in dimension in the cavity at the higher temperature tends to decrease the resonant frequency.

In the filter 100 shown in FIG. 4, Applicants have identified through experimentation that a dielectric resonator material with a positive temperature coefficient of about 3 ppm/° C. is required in order to compensate for the mechanical variations in the cavity 110 as a result of temperature variation. To further explain this feature, it is first noted that dimensions of the cavity 110 vary with the temperature (ambient and conducted) in the filter 100, which in the present transmitter application can be extreme (e.g., between 0° C. and 50° C.). In the preferred embodiment, as the temperature increases, the frequency shift caused by a dimensional increase in the cavity 110, tends to lower the resonant frequency due to increased size of the cavity 110 and decreased loading on the dielectric resonator 112.

Consequently, using the dielectric resonator 112 with a positive valued temperature coefficient tends to offset the frequency shift caused by the changed dimension of the resonant cavity 110. Accordingly, proper selection of the dielectric resonator material used in the dielectric resonator 112 will allow for automatic temperature compensation in the respective resonate cavities, 110, 122, 124 and 126.

The microstrip transmission line 130 is fabricated in a printed circuit board 108, the structure of which will later be discussed in detail with respect to FIG. 7. Respective segments of the transmission line 130 feed the input RF signal to each of the resonant cavities 110, 122, 124, and 126. A distance between the dielectric resonator 112 and the microstrip transmission line 130 affects an amount of coupling necessary to ensure the amount of filtering that is required in the present application, and an amount of loading on the dielectric resonator 112. In this embodiment, a center notch frequency for the first cavity 110 is set at 3 MHZ above the upper band edge of a channel pass band. Assuming the channel pass band frequency is 6 MHZ, the dielectric resonator 112 has a diameter a diameter and height as shown in Table 1 below for specific frequency ranges. Under these conditions the amount of attenuation that is achieved is about 15 dB, but always exceeds 12 dB.

TABLE 1

| FREQUENCY RANGE (MHZ) | DIAMETER (inches) | HEIGHT (inches) |
|---|---|---|
| 2055–2125 | 1.1 | 0.503 |
| 2120–2190 | 1.04 | 0.500 |
| 2280–2350 | 1.05 | 0.466 |
| 2340–2410 | 0.944 | 0.433 |
| 2480–2560 | 0.875 | 0.404 |
| 2550–2630 | 0.842 | 0.404 |
| 2620–2700 | 0.804 | 0.404 |

The inherent quality factor "Q" of the dielectric resonator 112 is >13,000, which is unacceptably high in the present application, and thus must be loaded. Near resonance, the cavity 110 may be represented as a shunt-resonant circuit characterized by a loaded Q, where $Q=Q_L$ and $1/Q_L=(1/Q_0)+(1/Q_{ext})$. In the above equation, $Q_0$ is the unloaded Q characteristic of the cavity, while the $1/Q_{ext}$ is an amount of loading on the dielectric resonator that can be attributed to external circuits. By observing the frequency response for a given notch frequency, the resulting loaded Q can be determined. According to the frequency response shown in FIG. 8A, for example, the loaded Q was determined to be 2,000. Thus, the Q for the dielectric resonator can be lowered to 2,000 so as to provide a proper bandwidth (i.e., not too narrow) according to the specifics of the characteristic shape of the frequency response desired. Accordingly, the proximity of the dielectric resonator 112 to the microstrip line 130 not only provides a coupling mechanism but also provides sufficient loading of the dielectric resonator 112 so as to lower the Q of the dielectric resonator.

For a base having a height of 0.15" and a printed circuit board 108 having a dielectric thickness of 1/16", a distance $D_{load}$ (see, e.g., FIG. 7) is preferably in the range of 0.6 inches to 0.7 inches and in the preferred embodiment is set to 0.618 inches. The preferred range was empirically determined for $D_{load}$, by changing the bored hole 132 into a slot having a primary longitudinal in the direction of $D_{load}$ (FIG. 7). Using the slot, the distance $D_{load}$ was adjusted between the trace 131 of the microstrip transmission line 130 and dielectric resonator 112 until the amount of attenuation at the desired frequency was obtained (as observed for example in FIG. 8A).

Accordingly, any effect by the respective dielectric resonators 112 on the transmission line 130 impedance should be minimized so as to avoid any linear distortion of the signal in the form of asymmetrical frequency response and group delay. These linear distortion effects and techniques for compensating the same will later be discussed in reference to FIGS. 8A–C and FIGS. 9A–C.

Figure 5:
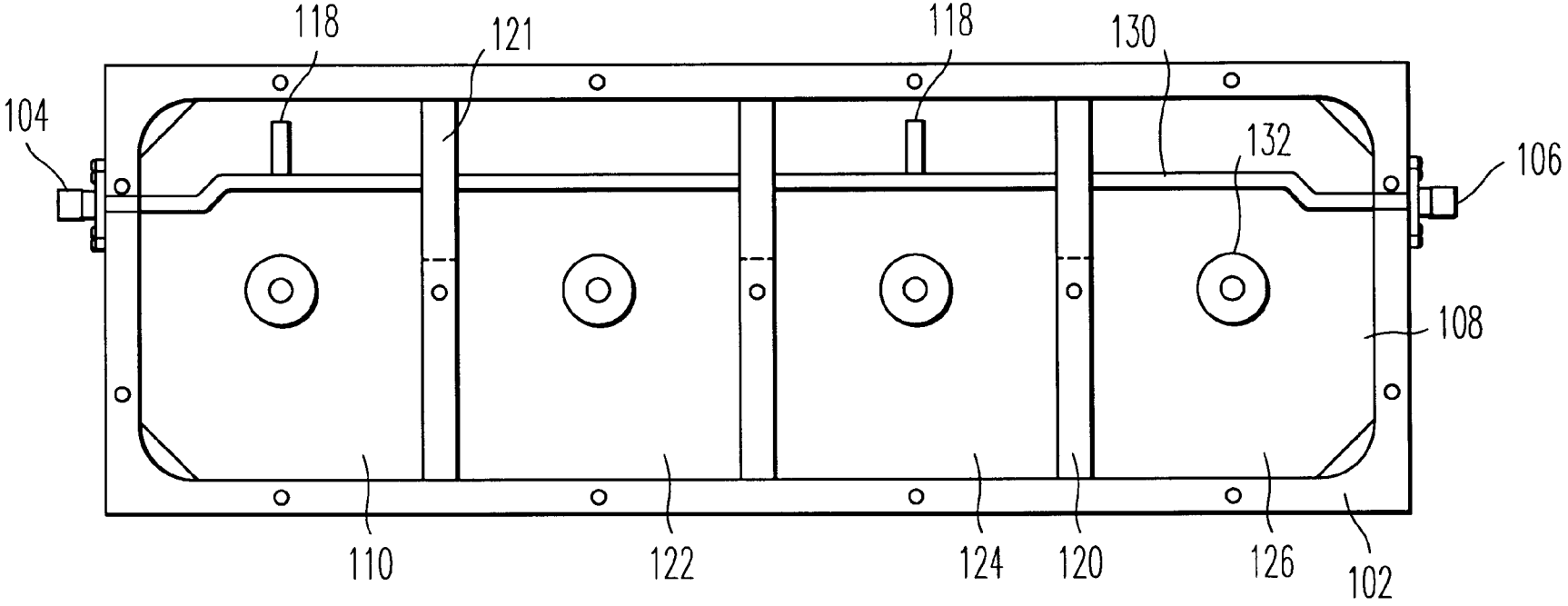
FIG. 5 is a front view of a housing assembly with a printed circuit board and microstrip transmission line according to the present invention.

FIG. 5 is a side view diagram of selected components of the resonant filter 100 in which a periphery of the respective cavities 110, 122, 124, and 126 are shown. The microstrip transmission line 130 is formed in the PC board 108, and the PC board 108 is disposed in the hollowed portion of the housing 102. The PC board 108 serves as a compact medium by which high power RF energy at frequencies in excess of 2 GHz is passed from the connector 104 to the output connector 106. A notched portion 121 is formed in each wall 120, and that notched portion is placed over the exposed portion of the microstrip transmission line 130 so that the wall 120 is electrically insulated from a current in the microstrip transmission line 130. Coupling to each of the cavities 110, 122, 124, and 126 is performed with exposed planar segments of the transmission line 130 that impart RF energy into the respective cavities 110, 122, 124, and 126.

Within each of the respective cavities 110, 122, 124 and 126, the bored portion 132 is formed through the PC board 108 so that the base 114 may attach directly to the housing 102, without connecting to the PC board 108. By directly attaching the base 114 to the housing 102, the dielectric resonator 112, which is affixed to the base 114 is not subject to relative motion with the PC board 108 as a result of thermal expansion and contraction of the PC board 108.

Also shown in FIG. 5, two stubs 118 are soldered to the microstrip line 130 in order to cancel an impedance disturbance of the microstrip line 130 caused by the particular dielectric resonators 112 in the first and third cavities (i.e., cavities 110, and 124). As will be discussed in more detail with respect to FIGS. 8A–C and 9A–C, the length and positioning of the stubs 118 are positioned opposite to the dielectric resonators 112 on the microstrip line 130 so as to impart a complementary reactance on the microstrip line 130 that counterbalances an impedance disturbance caused by the dielectric resonators 112 of cavities 110 and 124. A first benefit of the stubs is that the relative spacing of the resonant cavities 110, 122, 124, and 126 need not be at a particular interval with respect to one another because the impedance disturbances can be offset with the stubs 118. Another benefit offered by the stubs 118 is that a symmetric frequency response and group delay is made possible by removing the impedance disturbances caused by the dielectric resonators. The length of the stubs 118 is a design variable and is set according to the magnitude and phase of the disturbance caused by the respective dielectric resonators 112. In the present embodiment, the length of the stubs 118 are in the range of 0.05" to 0.3", where the shorter stubs are used for the upper channels of the wireless cable band, and the larger stubs are used at the lower channels of the wireless cable band.

Figure 6:
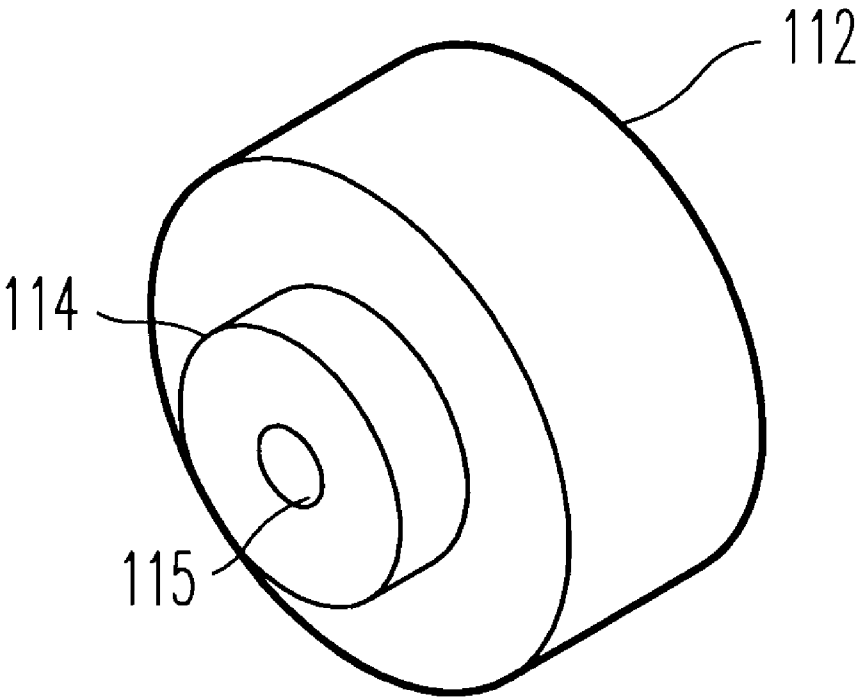
FIG. 6 is a perspective view of a base and dielectric resonator assembly according to the present invention.

FIG. 6 is a perspective view of one of the dielectric resonators 112 with the base 114 and through hole 115, which receives the polyester screw 119 (FIG. 4). As earlier discussed, the dielectric resonator 112 has a cylindrical shape (although other shapes may be used as well) having a diameter that is a variable dimension depending on the frequency to be notched. The bands in Table I were chosen to provide the same dielectric resonator for all of the four notches in the filter within a respective channel. This procedure has a big impact on reducing cost and allowing standardization.

The base 114 is made of a Coderite material and is bonded to the dielectric resonator 112 using an Araldite 2011 multipurpose adhesive which is applied between 0.002 to 0.004 inches thick on the base 114. A diameter of the base is 0.472 inches in the exemplary embodiment, although other dimensions will work suitably well provided the base 114 fits through the bored portion 132 of the PC board 108 and attaches to the housing 102. By attaching the dielectric resonator 112 and base 114 to the housing 102 directly, and not to the circuit board 108, a position of the dielectric resonator 112 does not change as a result of an expansion/contraction of the circuit board 108 due to temperature variations. Empirical evidence indicates the present construction has a very stable performance over a wide variety of temperatures.

Figure 7:
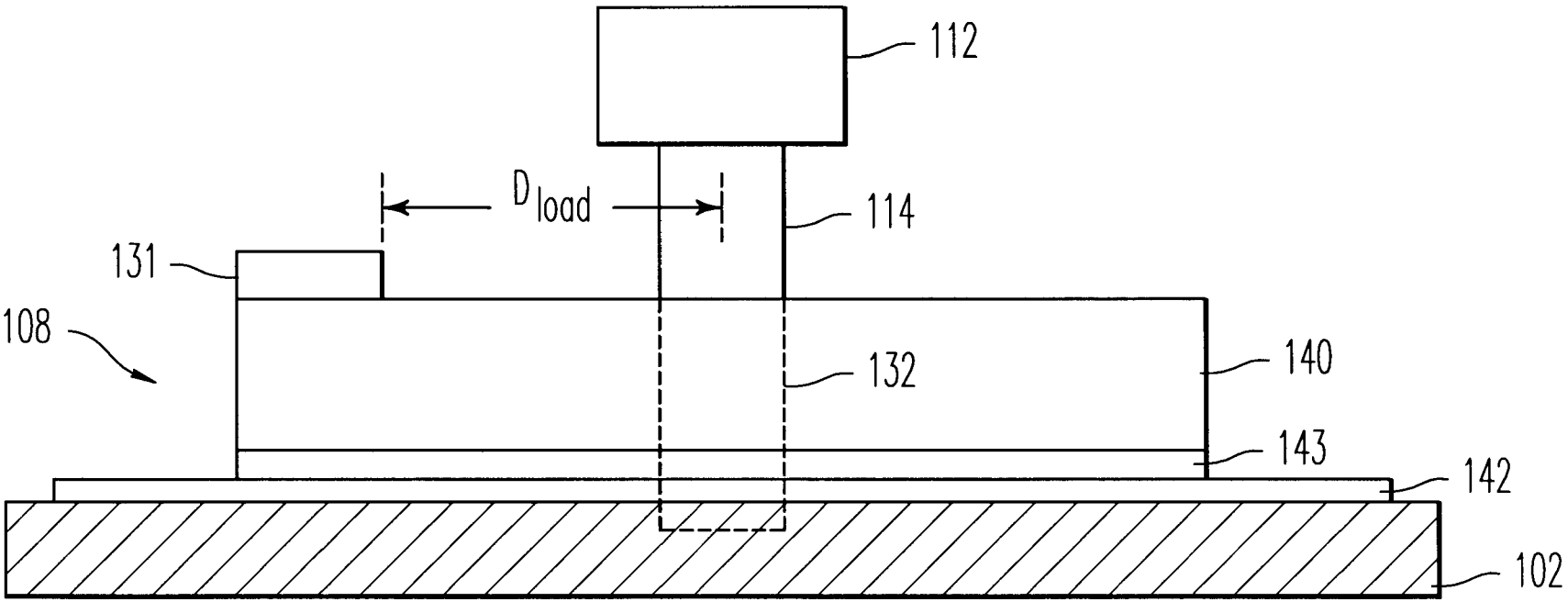
FIG. 7 is a cross-section of a dielectric resonator, a base, a printed circuit board and a housing assembly arrangement according to the present invention.

FIG. 7 is a side view showing a positional relationship of the dielectric resonator 112, the base 114, the circuit board 108 and the housing 102. In particular, the base 114 is shown to extend through the bored portion 132 of the circuit board 108 directly into the housing 102. The printed circuit board 108 is conductively bonded to the housing 102 with a conductive bonding agent 142. On top of the conductive bonding agent 142, is a conductive layer 143 made of a conductor such as copper or the like. On top of the conductive layer is a dielectric layer 140. The dielectric layer 140 is preferably made of Teflon (polytetrafluoro-ethylene), although other suitable dielectric materials may be used as well. Teflon is preferred because it has desirable dielectric properties that provide substantial insulation at relatively close distances and thus can support handling the higher power RF signals that propagate through the printed circuit board 108. On top of the dielectric layer 140 is formed a conductive trace layer 131 which serves as the top layer of the microstrip transmission line 130. The conductive trace layer 131 is made of copper or other suitable conductive material and has a width of 0.176 inches so as to provide a 50 Ω impedance. A conductor protective finish may optionally be applied to the circuit board 108 of FIG. 7, although not expressly shown in FIG. 7. A thickness of the printed Teflon layer 140 in the circuit board 108 is 1/16" for 200 W channels and 1/32" for 15 W channels. For measuring convenience, the distance $D_{load}$ is measured from a nearest edge of the conductive trace layer 131 to beneath a center of the dielectric resonator 112, as shown in FIG. 7.

Figure 8B:
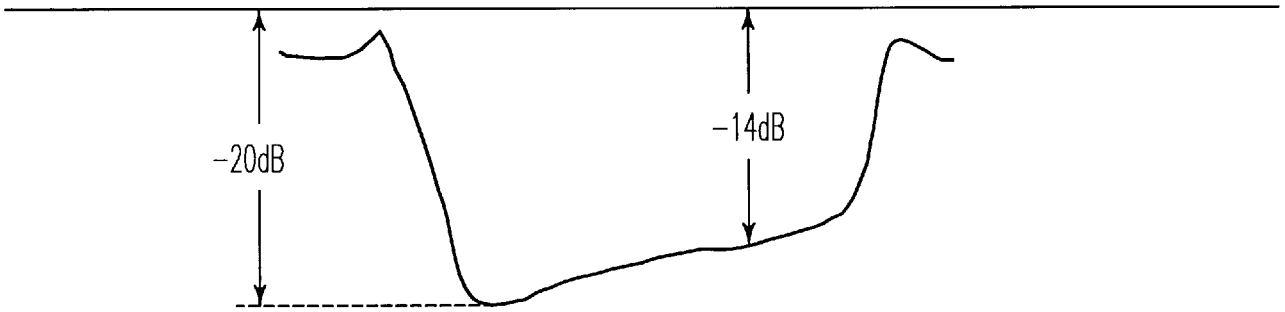
Figure 8C:
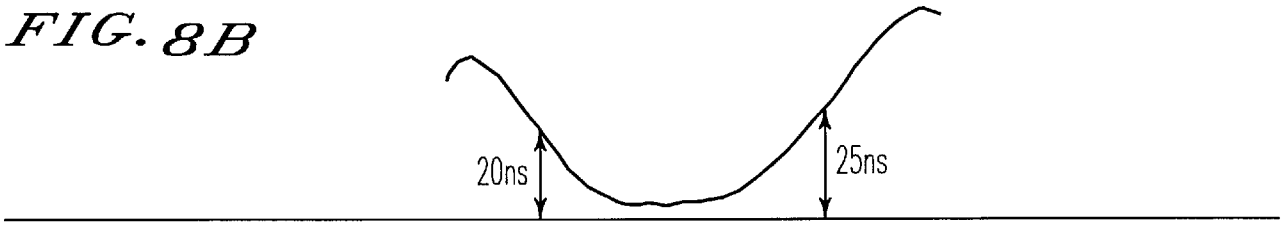

FIGS. 8A–8C are related graphs that respectively show a frequency response, return loss, and group delay of the filter 100. In the frequency response graph of FIG. 8A, a 6 MHZ channel band is represented by the symbol $f_{ch}$ and has a lower and upper edge thereof represented by vertical dashed lines. When used in a digital signal application, the filter is exposed to a digitally modulated signal that has sidelobes often occurring at +/−6 MHZ from the channel band, $f_{ch}$, which is a center frequency of the adjacent channel. The locations of the respective notched frequencies C1–C4 are thus selected to suppress out-of-band energy that occurs at the centers of the adjacent channels. Consequently, the position of the notch C1 created by cavity 110 is set to occur at 3 MHZ above the upper edge of the channel band, $f_{ch}$. Similarly, the notch C2 is created by cavity 122 and is set to occur at 3 MHZ below the lower band of the channel band. Consequently, a frequency separation between the respective notch frequencies C1–C2 is 12 MHZ as represented by $f_{1,2}$. The notch C3 is created by the cavity 124 and is offset by an additional 6 MHZ from the notch C1. Likewise, the notch C4 is created by the cavity 126 and is offset by an additional 6 MHZ from the notch C2 so that a separation between notches C4 and C3 is 18 MHZ.

An insertion loss of the filter 100 and a depth of the respective notches is measured in the graph of FIG. 8A with respect to a horizontal line at the top of FIG. 8A indicating an input signal power. As seen, in the channel band $f_{ch}$ portion of the graph, an insertion loss of 0.5 dB is observed. Furthermore, the depths of notches C1–C4 is observed to be at least 12 dB down from the input signal.

Another observation to be made from FIG. 8A is that a slope of the frequency response in a region $S_L$ is greater than a slope of the frequency response in another region $S_u$. This asymmetry is a result of a capacitive nature of a coupling of the microstrip transmission line 130 to the dielectric resonator 112. Moreover, the capacitive coupling disturbance to the impedance of the microstrip transmission line 130 is evident in FIGS. 8B and 8C.

FIG. 8B illustrates a return loss (i.e., 20 logΓ, where Γ is a reflection coefficient) caused by the impedance of the microstrip antenna line by the cavity 110 at notch C1. In the area of the lower edge of the channel band, $f_c$, a −20 dB return loss is observed. However toward the upper edge of the channel band, $f_c$, only a −14 dB return loss is observed, thus implying that an impedance disturbance is being caused by the dielectric resonator 112 in the cavity 110. A similar effect is observed in notch C3, which is associated with the cavity 124.

Furthermore, the impedance disturbance serves to expose the signal passing through the filter to an asymmetrical group delay, as is seen in FIG. 8C. In FIG. 8C that portion of the signal toward the lower end of the channel band, $f_c$, experiences a 20 nanosecond (ns) delay while the portion of the signal near the upper end of channel band $f_c$ experiences a 25 ns delay. Thus, unless corrected, the filter 100 would add some amount of linear distortion to the RF signal, which is particularly troublesome for digital signals.

As previously discussed with respect to FIG. 5, stubs 118 are soldered to the microstrip transmission line 130 at a location opposite to cavities 110 and 124. The reason why the stubs are added at these locations is because cavities 110 and 124 correspond to the notches C1 and C3 that produce the slighter slopes $S_u$ with respect to the steeper slopes $S_L$ which occur at frequencies above the channel band $f_c$.

Figure 9B:
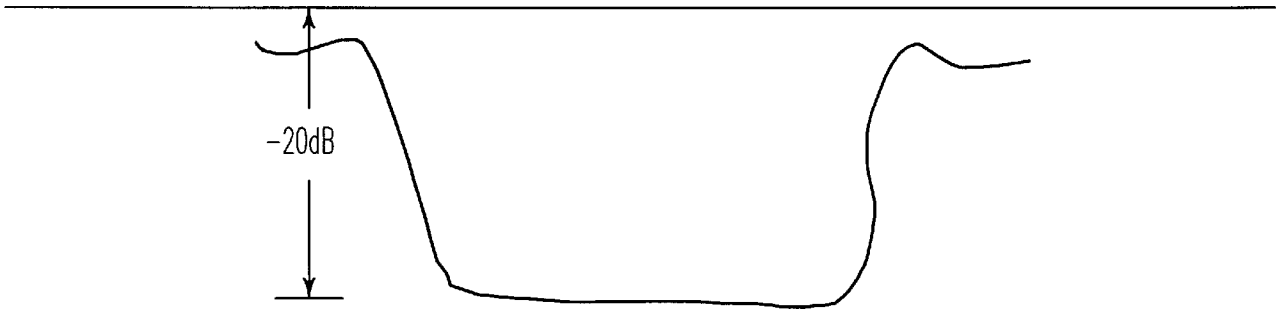
Figure 9C:
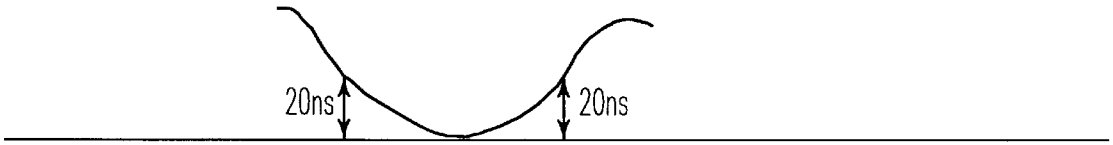

FIGS. 9A–9C illustrate the frequency response, return loss, and group delay of the filter 100 after the stubs 118 have been added to the microstrip transmission line 130. As previously discussed, the lengths of the stubs depends on the frequency of the channel band, $f_c$, and in the wireless cable transmitter application the lengths range from 0.05" for the upper frequencies to 0.3" for the lower frequencies. The stubs 118 act to counterbalance the capacitive impedance disturbance caused by the cavities 110 and 124 by applying an impedance having an opposite phase to that imposed by the cavities 110 and 124. By correcting for the impedance disturbances caused by the cavities 110 and 124 with the stubs 118, a steepness of the upper slope $S_u$ approximates that of the lower slope $S_L$, thereby providing a symmetric frequency response. Similarly, FIG. 9B shows that in the channel band, $f_c$, a return loss is uniformly distributed at −20 dB, and FIG. 9C shows that a symmetric group delay is imparted on the signal with 20 ns delays occurring at the lower and upper band edges of the channel band $f_c$.

While the above description has been provided with respect to specific embodiments of the invention, it is clear that the teachings of the present disclosure may be applied to other frequency bands consistent with the teachings herein. Furthermore, specific materials such as the dielectric materials, conductor materials in the PC board 108, housing 102, microstrip line 130 may be substituted for similar materials performing similar functions, consistent with the teachings of the present invention. Likewise, the shapes of particular components (e.g., dielectric resonators 112 and cavity 110) described herein are not intended to be limited to only the specific shapes disclosed herein, but applies to other shapes as will be appreciated by those of ordinary skill in the radio frequency art.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A signal filter that passes an in-band portion of an amplified radio frequency signal to be transmitted from an antenna and suppresses an out-of-band portion of said amplified radio frequency signal, comprising:

a housing having a hollow interior portion;

an input terminal connected to said housing and configured to receive said amplified radio frequency signal as an input signal;

plural resonant cavities contained within said hollow interior portion of said housing, each comprising conductive walls and a dielectric resonator configured to suppress a narrowband frequency component in said out-of-band portion of said amplified radio frequency signal;

a microstrip transmission line disposed within said hollow interior portion of said housing, comprising, a dielectric layer, a conductive trace having a planar external surface, and a conductive layer, said dielectric layer being sandwiched between said conductive trace and said conductive layer, said microstrip transmission line connected on one end to said input terminal and configured to receive said input signal, respective segments of said planar external surface of said conductive trace exposed to an interior portion of respective of said plural resonant cavities so that at least one of said dielectric resonator suppresses said narrowband frequency component and provides a filtered output signal at another end of said microstrip transmission line, and a stub for providing a symmetrical frequency response and group delay in said in-band portion between at least two of said narrowband frequency components filtered by at least two of said resonant cavities; and an output terminal connected to said housing and said another end of said microstrip transmission line and configured to output said filtered output signal.

2. The filter of claim 1, wherein:

said each conductive walls comprises a material having a negative temperature coefficient; and said each dielectric resonator comprises a ceramic material having a positive temperature coefficient that is matched in magnitude to said negative temperature coefficient of said conductive walls.

3. The filter of claim 2, wherein:

said microstrip transmission line comprises a trace layer which comprises said conductive trace, and said microstrip transmission line having a bored portion formed therein; and said each dielectric resonator of said plural resonant cavities comprising a base disposed through said bored portion, said base attached on a first surface to said dielectric resonator and attached on a second surface to said housing.

4. The filter of claim 1, wherein said microstrip transmission line comprises a printed circuit board on which said conductive layer is formed, said dielectric layer formed over said conductive layer of said printed circuit board.

5. The filter of claim 4, wherein said dielectric layer comprises polytetrafluoro-ethylene.

6. The filter of claim 4, wherein a thickness of said dielectric layer is in a range of 1/32 and 1/16 of an inch and supports transmission of signal frequencies in at least one of a first frequency range between 2.15 GHz and 2.162 GHz and a second frequency range between 2.5 GHz, to 2.686 GHz.

7. The filter of claim 1, wherein said stub is conductively connected to said conductive trace, said stub having an impedance that counterbalances an impedance disturbance on said microstrip transmission line caused by said dielectric resonator.

8. The filter of claim 7, wherein said stub is disposed at a location on said microstrip transmission line that is across from at least one of said plural resonant cavities.

9. The filter of claim 7, wherein said stub has a length in the range of 0.05 inches to 0.3 inches.

10. The filter of claim 1, further comprising a tuning disk adjustably disposed within one of said plural resonant cavities at a variable distance from a dielectric resonator, a center frequency of said narrowband frequency component varying with said variable distance.

11. The filter of claim 10, wherein said tuning disk comprises at least one of a manually tunable tuning disk and an automatically tunable tuning disk.

12. The filter of claim 1, wherein at least one of said conductive walls being arranged in a plane that is substantially normal to a plane of said planar external surface of said conductive trace, said at least one of said conductive walls having a notched portion formed therein, said notched portion insulatively disposed over said planar external surface of said conductive trace.

13. A signal filter that passes an in-band portion of an amplified radio frequency signal to be transmitted from an antenna and suppresses an out-of-band portion of said amplified radio frequency signal, comprising:

a housing having a hollow interior portion;

an input terminal connected to said housing and configured to receive said amplified radio frequency signal as an input signal;

resonant cavity means for suppressing magnitudes of a lower narrowband frequency component and an upper narrowband frequency component in said out-of-band portion of said amplified radio frequency signal;

microstrip transmission line means for accepting said input signal from said input terminal, feeding said input signal to said resonant cavity means, and outputting a filtered output signal having said out-of-band portion suppressed in magnitude with respect to said input signal;

means for providing a symmetrical frequency response and group delay in said in-band portion between said lower narrow band frequency component and said upper narrowband frequency component; and an output terminal that provides said filtered output signal from said microstrip transmission line means to an external device.

14. The filter of claim 13, further comprising temperature stabilizing means for automatically compensating for temperature induced frequency changes in said resonant cavity means.

15. The filter of claim 13, wherein said means for providing a symmetrical frequency response and group delay comprises impedance compensating means for counterbalancing an impedance disturbance on said microstrip transmission line means caused by said resonant cavity means.

16. The filter of claim 13, wherein said resonant cavity means comprises tuning means for changing a frequency of said frequency component.

17. The filter of claim 13, wherein:

said resonant cavity means establishes a resonance condition in at least one of a first frequency range between 2.15 GHz and 2.162 GHz and a second frequency range between 2.5 GHz, to 2.686 GHz; and said microstrip transmission line means for passing said in-band portion of said radio frequency signal in at least one of said first frequency range and said second frequency range.

18. The filter of claim 13, further comprising means for preserving a frequency symmetry of the in-band portion of said amplified radio frequency signal and applying a symmetrically shaped group delay to said in-band portion of said amplified radio frequency signal.

* * * * *